United States Patent [19]

Urban

[11] 4,324,122

[45] Apr. 13, 1982

[54] METAL STRIP COLD-REDUCTION MILL

[75] Inventor: Peter Urban, Meerbusch-Osterrath, Fed. Rep. of Germany

[73] Assignee: Eduard Küsters, Krefeld, Fed. Rep. of Germany

[21] Appl. No.: 139,753

[22] Filed: Apr. 14, 1980

[30] Foreign Application Priority Data

May 2, 1979 [DE] Fed. Rep. of Germany ..... 2917641

[51] Int. Cl.[3] ..... B21B 45/02

[52] U.S. Cl. ..... 72/41; 72/45; 72/201

[58] Field of Search ..... 72/41, 43–45, 72/201, 200, 251; 242/78.1

[56] References Cited

U.S. PATENT DOCUMENTS

| | | | |
|---|---|---|---|
| 2,211,981 | 8/1940 | McBain et al. | 72/201 |
| 4,047,985 | 9/1977 | Greenberger | 72/201 X |
| 4,154,078 | 5/1979 | Lehman | 72/201 |

FOREIGN PATENT DOCUMENTS

| | | | |
|---|---|---|---|
| 1954893 | 5/1971 | Fed. Rep. of Germany | 72/41 |

*Primary Examiner*—Ervin M. Combs
*Attorney, Agent, or Firm*—Kenyon & Kenyon

[57] ABSTRACT

A metal strip cold-reduction mill having small work rolls with the rolls and strip flooded with liquid lubricant, has a tension reel on which the strip leaving the work rolls is coiled for tensioning the strip in the work rolls. A set of squeeze rolls between the work rolls and the reel removes the lubricant from the strip before the strip is coiled on the reel. At least one of the squeeze rolls is a controlled deflection roll.

7 Claims, 3 Drawing Figures

METAL STRIP COLD-REDUCTION MILL

BACKGROUND OF THE INVENTION

Metal strip and particularly steel strip is cold-reduced by a cold reduction mill having work rolls between which the strip is pulled by a tension reel on which the strip coils. The mill has means for flooding the work rolls and strip with a liquid lubricant for cooling and to faciliate the cold rolling. If this lubricant remains on the strip leaving the work rolls, it forms a lubricant layer between the strip convolutions coiling one on top of another on the reel.

With the strip pulled from the work rolls under tension by the tension reel, the lubricant between the strip convolutions of the coiling strip on the reel can cause the convolutions to suddenly slip in the axial direction of the reel and cause an accident.

Therefore, a set of squeeze rolls is positioned between the work rolls and the reel, so that the strip passes between the rolls to squeeze the lubricant from the strip. Heretofore, the squeeze rolls have been solid cylindrical rolls. The rolls can be cambered or crowned to compensate for roll deflection or bending under the force applied to the ends of the rolls to form a nip having an adequate line pressure to squeeze the lubricant from the strip.

The above technique has not been completely successful, particularly when applied to a Sandzimir mill having work rolls of very small diameter, such as can be exemplified by diameters of from 1 to 2½". The work rolls and the strip are heavily flooded with a liquid lubricant such as an oil emulsion or palm oil, and the strip tension applied by the reel is very high. If the coil convolutions on the reel suddenly slip axially, a serious accident occurs.

The present invention has resulted from study showing that the liquid lubricant remaining on the strip leaving the work rolls is sometimes unevenly distributed on the strip, causing fluctuation in the squeeze roll's nip line pressure so that all of the lubricant is not squeezed from the strip before the strip reaches the reel.

Furthermore, a Sandzimir mill is a reversing mill having a tension reel on each of its opposite sides, the strip traveling back and forth from one reel to the other as the mill reverses. During reversals, the mill and reels must decelerate to a stop, reverse direction, and then accelerate to full rolling speed. Two sets of squeeze rolls must be used, with one set on one side of the mill and the other on the other side of the mill, the squeeze rolls in each instance being located between the mill's work rolls and the reel. Possibly the temperature fluctuations prevent the maintenance of the desired nip line pressure which the squeeze rolls require to squeeze off the lubricant completely.

A Sandzimir mill is used to cold reduce steels of the harder grades, such as stainless and high silicon steel, and uses extremely high strip tension to facilitate the cold reduction by the small work rolls. Therefore, what might be adequate lubricant removal prior to coiling on the tension reel in other instances, apparently is insufficient to insure firm and slip-free coiling in the case of a Sandzimir mill.

SUMMARY OF THE INVENTION

The present invention comprises the replacement of at least one of the solid rolls of each squeeze roll set by a controlled deflection roll which permits the squeeze rolls to provide a controlled line pressure for the nip formed by the two squeeze rolls and through which the tensioned strip passes for lubricant removal.

Controlled deflection rolls are of different types but any type can provide a nip line pressure that is uniform from end-to-end in the axial direction of the rolls. One controlled deflection roll working against a plain solid roll can compensate for the deflection of that roll by the controlled deflection roll bending as does the solid roll and in the same direction.

Characteristically all controlled deflection rolls comprise a stationary shaft extending through a rotative cylindrical shell roll having an exterior forming the rolling surface and a hollow interior spaced from the shaft so that the roll and shaft have freedom to individually deflect under beam stress. The shaft extends beyond the shell or hollow roll so that its ends can receive the force required to provide the desired nip line pressure with the counter roll involved which may itself be a controlled deflection roll if desired. In the circumferential space between the shaft and the shell's inside, means are provided for applying a uniform force between the shaft and shell on the side of these parts which receive the force from the other roll.

If at its ends the roll's shell is journaled on the shaft, the shell roll can be cambered or crowned regardless of the flexure of the counter roll. If such bearings are not used, the shell or hollow roll in effect floats relative to the shaft, its contour or flexure then being controlled by the deflection of the counter roll via variations in the internal pressure between the shaft and shell of the controlled deflection roll.

An example of the first type where bearings are used at the ends of the shaft to journal the shell roll can be seen in the Kusters U.S. Pat. No. 3,023,695, Mar. 6, 1962, while the Appenzeller U.S. Pat. No. 2,908,964, Oct. 20, 1959, provides an example of the second type wherein such end bearings are not used, permitting the shell roll to float on the pressure or force between it and the stationary shaft.

Heretofore it was not known that there was any need for precision control of the line pressure of the nip formed by the squeeze rolls used between the liquid lubricant flooded work rolls and the tension reel to remove the lubricant from the strip. Serious accidents at the tension reel involving sudden axial slippage of the highly tensioned metal strip convolutions could be blamed on the features such as lack of absolute parallelism between the reel and the work rolls, possibly transversely uneven strip thicknesses due to the inaccurate work roll adjustments, etc.

Using the present invention, simple observation of the lubricant distribution on the strip leaving the work rolls permits appropriate adjustment of the line pressure of the squeeze roll nip to remove all of the lubricant before the strip reaches the tension reel. Possibly changes in strip and lubricant temperature, strip gauge variations, etc., previously considered to be of small consequence, can be compensated quickly. Lubricant observed as remaining on the strip leaving the squeeze rolls and providing an indication of imminent trouble at the tension reel can be quickly terminated by appropriate adjustment of the squeeze roll nip pressure made possible by the use of the controlled deflection roll.

BRIEF DESCRIPTION OF THE DRAWINGS

The accompanying drawings schematically illustrate the principles of this invention, the various views being as follows.

DETAILED DESCRIPTION OF THE INVENTION

Figure 1:
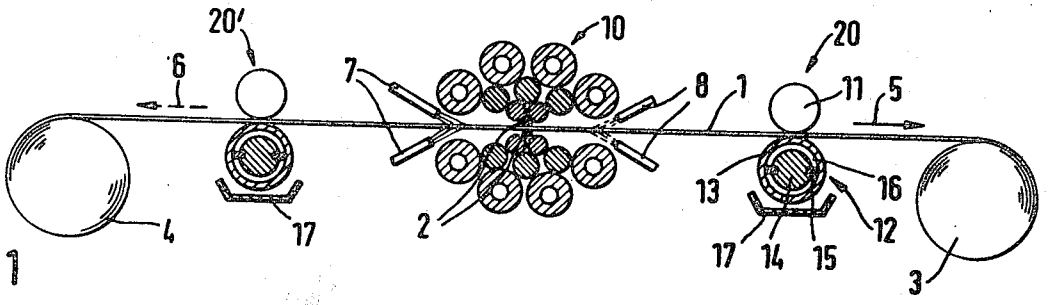
FIG. 1 is a side elevation of a Sandzimir mill with its two tension reels and sets of squeeze rolls.

In the above drawings in FIG. 1 the steel strip 1 is shown as being cold reduced by the typically small work rolls 2 of a Sandzimir mill, the numeral 10 indicating the mill as a whole. The small work rolls are held against bending or flexing by the typical cluster of backup rolls. To assist the cold reduction, the strip 1 is tensioned by the tension reels 3 and 4. When the strip travels in the direction indicated by the arrow 5, the reel 3 is coiling the strip under the high tension, and when the operation reverses so that the strip is traveling in the direction indicated by the arrow 6, the reel 4 is supplying the high tension. Being schematic, the drawings illustrate only the coiled strip but it is to be understood that as usual the coil is formed by the usual tension reel in each instance.

Both the work rolls and strip are flooded with liquid lubricant via the applicator devices 7 and 8. When the strip is going in the direction 5, at least the devices 8 are operating, and when going in the strip traveling direction 6, at least the devices 7 are operating. The work rolls and strip are heavily flooded with the lubricant.

The strip leaving the work rolls should have all of the lubricant removed before reaching the reel involved, and this is the function of the squeeze roll sets indicated at 20 and 20' in FIG. 1. In both instances, the upper roll 11 is a plain solid steel roll characteristically capable of flexing or deflecting under the beam stress involved, more or less depending on the nip pressure involved. It is the lower roll indicated at 12 that is in this instance the controlled deflection roll.

Figure 2:
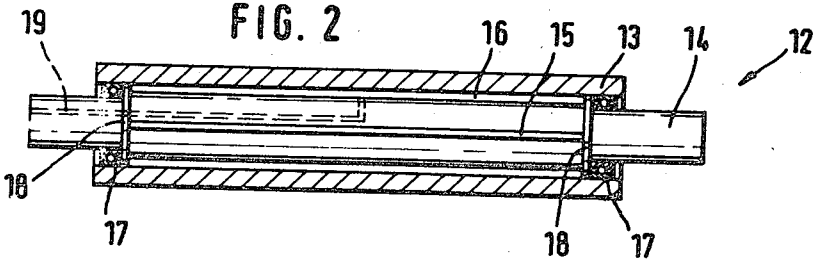
FIG. 2 is a longitudinal section taken through a controlled deflection roll of the type using bearings between the stationary shaft and the ends of the rotative shell roll.

In FIG. 2 the controlled deflection roll is illustrated as comprising the rotative cylindrical shell roll 13 through which the stationary shaft 14 extends with its ends projecting beyond the ends of the shell roll so that the assembly can be mounted with the shaft rigidly supported, although possibly variably positioned relative to the upper roll 11 in FIG. 1. The usual side seals 15 and end seals 15' form the chamber 16 on the upper or force-receiving side of the roll and to which pressurized fluid may be introduced via a conduit 16'. Outside of the end seals 15' self-aligning anti-friction bearings 17 journal the rotative shell roll 13 at its ends on the shaft 14 so that at these ends there is no possibility for radial movement of the shell relative to the shaft.

A controlled deflection roll of the type illustrated by FIG. 2 can by varying the fluid pressure in the space 16 be caused to conform generally to the contour of the counter roll 11 regardless of the latter's beam flexure, thus providing for a reasonably uniform line pressure as to the nip formed between the two squeeze rolls. However, if a uniform line pressure cannot remove the lubricant from the strip, appropriate control of the pressure in the space 16 can cause the shell roll 13 to bend towards or away from the other roll 11. By observation of the strip leaving the squeeze rolls, it becomes possible to completely remove all of the lubricant from the strip before it is coiled by the tension reel.

Figure 3:
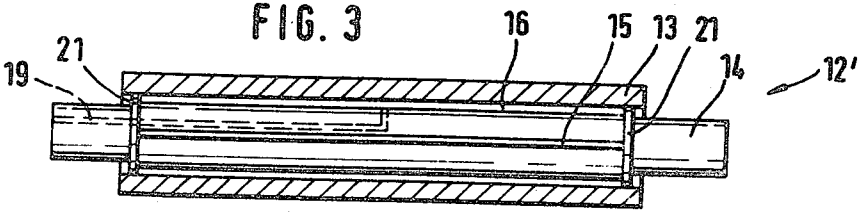
FIG. 3 is a corresponding view but showing the other type not using the end bearings and permitting the rotative shell to float relative to the stationary shaft.

In the case of the roll 12' shown by FIG. 3, it can be seen that the bearings 17 are eliminated and that in this case end seals 21 are used which permit relative movement of the shell roll 13 relative to the stationary shaft 14 throughout the entire length of the shell roll including its ends. Therefore, for controlled deflection this roll of FIG. 3 depends on the beam flexure of its counter roll. However, a completely uniform line pressure can be formed between this roll and its counter roll.

Under many operating conditions, either of the controlled deflection rolls 12 and 12' remove the liquid lubricant from the traveling strip effectively, the squeezed off liquid lubricant falling into one or the other of the pans 18 as the case may be. It is to be understood that in all instances the chamber 16 is on the side of the roll receiving the pressure caused by working against the counter roll, and this chamber 16 may extend for substantially 180° around that side of the roll between the stationary shaft and the shell roll. Instead of using this chamber 16 for applying the force between the shaft and the shell or hollow roll, a possible substitution might be the use of cylinder and piston arrangements working against the shell or hollow roll's inside via suitable shoes as is illustrated by the Kusters et al U.S. Pat. No. 3,131,625, May 5, 1964.

However, in all cases, there should be a uniform pressure or force exerted between the stationary shaft and throughout the inside of the working length of the shell roll. Systems are commercially available for precisely adjusting this internal force applied throughout the length of the shaft to the shell roll. This pressure and, therefore, the external contour of the roll can be varied quickly and precisely so that the line pressure of the nip between the two rolls 11 and 12 can be controlled or adjusted as required for the strip to leave the squeeze rolls in a dry condition preventing its convolutions from axially slipping when the strip is coiled under high tension with one convolution on top of the other.

What is claimed is:

1. A metal strip cold-reduction mill comprising work rolls between which the strip is cold-rolled, means for applying liquid lubricant to the strip and work rolls during cold rolling of the strip, the lubricant remaining on the rolled strip leaving the work rolls, a tension reel on which the rolled strip is coiled with one convolution on top of another, and a set of squeeze rolls between the work rolls and reel and forming a nip through which the rolled strip is passed for removing the lubricant from the strip; wherein the improvement comprises controllable means for adjusting the line pressure of said nip along its length.

2. The mill of claim 1 in which said controllable means comprises at least one of said squeeze rolls being a controlled deflection roll.

3. The mill of claim 2 in which said controlled deflection roll comprises a cylindrical shell roll externally forming said nip with the other squeeze roll, a stationary shaft radially spaced from and extending through the inside of said shell roll for at least the length of said nip, and means for applying a force in the direction of said nip between the shaft and the shell roll's said inside, said force being substantially uniform throughout at least the length of said nip.

4. The mill of claim 3 in which said shell roll and shaft have ends which are journaled together by bearings preventing radial displacement of said ends relative to each other.

5. The mill of claim 3 in which said shell roll throughout its entire length is free to move radially independently of said shaft at least in the direction of said nip.

6. The mill of claim 3 in which said work rolls are the work rolls of a Sandzimir mill.

7. The mill of claims 3, 4, 5 or 6 in which the means for applying said force is a body of pressurized fluid between the shaft and the inside of said shell roll opposite to said nip.

* * * * *